US006875397B2

(12) United States Patent
Fofonoff

(10) Patent No.: US 6,875,397 B2
(45) Date of Patent: Apr. 5, 2005

(54) METHODS FOR BIOPOLYMER COAGULATION

(75) Inventor: Timothy W. Fofonoff, Dedham, MA (US)

(73) Assignee: TEI Biosciences, Inc., Boston, MA (US)

( * ) Notice: Subject to any disclaimer, the term of this patent is extended or adjusted under 35 U.S.C. 154(b) by 330 days.

(21) Appl. No.: 10/037,149

(22) Filed: Oct. 19, 2001

(65) Prior Publication Data

US 2003/0098527 A1 May 29, 2003

Related U.S. Application Data

(62) Division of application No. 09/519,247, filed on Mar. 6, 2000, now Pat. No. 6,705,850.

(51) Int. Cl.[7] ..... D01D 5/06; D01F 4/00

(52) U.S. Cl. ..... 264/561; 264/180; 264/202; 264/562

(58) Field of Search ..... 264/180, 202, 264/561, 562

(56) References Cited

U.S. PATENT DOCUMENTS

| | | | | |
|---|---|---|---|---|
| 750,502 | A | | 1/1904 | Thiele |
| 957,460 | A | | 5/1910 | Elasasser |
| 1,665,453 | A | | 4/1928 | Grunert |
| 2,154,893 | A | | 4/1939 | Eisenhurt et al. |
| 2,199,882 | A | | 5/1940 | Inokuchi et al. |
| 2,402,846 | A | | 6/1946 | Ryan |
| 4,192,838 | A | | 3/1980 | Keith et al. |
| 5,378,469 | A | | 1/1995 | Kemp et al. |
| 5,562,946 | A | | 10/1996 | Fofonoff et al. |
| 5,705,631 | A | | 1/1998 | Malcolm |
| 5,911,942 | A | * | 6/1999 | Fofonoff et al. ..... 264/444 |
| 6,234,778 | B1 | | 5/2001 | Belch et al. |

OTHER PUBLICATIONS

Y.P. Kato et al., "Formation of Continuous Collagen Fibres: Evaluation of Biocompatibility and Mechanical Properties," *Biomaterials*, vol. 11 pp. 169–175 (1990).

* cited by examiner

*Primary Examiner*—Leo B. Tentoni
(74) *Attorney, Agent, or Firm*—Fish & Richardson P.C.

(57) ABSTRACT

An apparatus for forming a fiber from a biocompatible biopolymer includes a fiber-formation tube that defines a bore extending generally vertically from an upper end to a lower end. Coagulation fluid enters the tube through a fluid inlet coupled to its upper end and establishes a laminar flow of coagulation fluid within the tube. A spinneret introduces a stream of liquid biopolymer into the laminar flow of coagulation fluid so that the stream is surrounded and swept downstream by the coagulation fluid as it coagulates into a biopolymer fiber. The laminar flow of coagulation fluid surrounding the biopolymer stream maintains the shape of the stream so that the resulting fiber is homogeneous in both geometry and structure. The laminar flow of coagulation fluid also prevents the resulting fiber from contacting the inner wall of the fiber-formation tube.

12 Claims, 6 Drawing Sheets

METHODS FOR BIOPOLYMER COAGULATION

This application is a divisional application of Ser. No. 09/519,247 filed on Mar. 6, 2000, now U.S. Pat. No. 6,705,850. The contents of all of the aforementioned application(s) are hereby incorporated by reference.

This invention relates to the field of tissue synthesis and in particular, to methods for the formation of biopolymer fibers.

BACKGROUND OF THE INVENTION

The need to replace tissue lost to disease or injury or as a result of surgical intervention has been a long standing one. Although wound repair can occur in the absence of tissue replacement, such wound repair is often accompanied by severe scarring and loss of function. In those cases in which a patient suffers from a circulatory disorder or from diabetes, a dermal wound may fail to heal for months or years. This extended failure of wound healing often leads to infection and chronic discomfort. More seriously, under many circumstances severe tissue loss can be life threatening and replacement or surgical restoration becomes an absolute necessity.

One approach to accelerating the body's self-healing process is to provide a scaffolding made of a biocompatible material populated with appropriate cells. A highly desirable type of scaffolding can be fabricated from a naturally occurring biopolymer fiber such as collagen fiber.

It has been traditionally difficult to spin collagen fibers which have dimensional and strength properties like those which occur in organisms in vivo. Fibers produced by methods which preserve the inherent biological information break easily when subjected to even small mechanical stress. It is therefore desirable in the art to provide a method and apparatus for manufacturing collagen fiber of multiple deniers under conditions which minimize stress on the fiber.

Because the collagen fiber is ultimately destined for implantation in a human body, it is desirable that it be free of contamination by extraneous matter and microorganisms. Consequently, it is desirable in the art to provide a method and apparatus for manufacturing collagen fiber in which the resultant fiber is reasonably free of such contaminants.

SUMMARY OF THE INVENTION

The formation of a fiber in a manner that reduces the mechanical stress on the fiber is accomplished, in an apparatus embodying the invention, by providing a fiber-formation tube that defines a tube axis extending generally vertically from an upper end to a lower end and having an inner wall defining a bore within the fiber-formation tube.

At the upper end of the fiber-formation tube is a fluid inlet for establishing a flow of coagulation fluid in a coagulation zone of the bore. A spinneret is then coupled to the bore at a point downstream from the fluid inlet so as to introduce a biopolymer into the coagulation zone. When introduced to the coagulation zone in this manner, the biopolymer is immediately surrounded by coagulation fluid. At the same time, the flow of coagulation fluid keeps the biopolymer from contacting the inner wall of the bore and sweeps the biopolymer downstream as it coagulates.

At a selected distance downstream from the spinneret, the biopolymer stream is fully coagulated to form a biopolymer fiber. At this point, or alternatively, anywhere downstream from this point, a fluid outlet is provided to separate the coagulation fluid from the coagulated biopolymer fiber. In another embodiment, the fiber is collected and retained with the coagulation fluid.

In either of these embodiments, coagulation of the fiber can be followed by cross-linking of the fiber. This is achieved by adding chemical cross-linking agents to the coagulation fluid or to a fluid that replaces the coagulation fluid. Cross-linking agents known in the art include aldehydes such as glutaraldehyde and formaldehyde; sugars such as ribose and fructose; acrylamides such as N,N'-methylenebisacrylamide;carbodiimides, such as 1-ethyl-3-(dimethyaminopropyl)carbodiimide; diones, such as 2,5-hexanedione; diimidates, such as dimethylsuberimidate; and iridoid derivatives such as genipin.

An apparatus embodying the invention can further minimize the mechanical stress experienced by the fiber as it coagulates by establishing a laminar flow of coagulation fluid within a laminar zone of the bore. As used herein, "laminar flow" refers to uniform laminar flow in which the velocity profile of the flow is symmetric about the tube axis. The term "non-uniform flow" refers to flow having an asymmetric velocity profile. This includes both laminar flow having an asymmetric velocity profile and non-laminar flow.

In this embodiment, the coagulation fluid inlet is coupled to an upstream end of the fiber-formation tube and disposed to create a laminar flow generally parallel to the tube axis. As a result of the laminar flow, no significant transverse forces disturb the coagulating fiber.

An advantage of an apparatus incorporating the invention is that because the fiber is relatively free of any mechanical stresses during its formation, very long and fine fibers approaching the dimensions and strengths of in vivo fibers can be readily produced.

Yet another advantage of an apparatus incorporating the invention is that because the fiber-formation tube is narrow, only a limited amount of coagulation fluid is needed. As a result, it is economically feasible to discard coagulation fluid after a single use and to use only fresh coagulation fluid during the fiber-formation process. This enables the resulting fiber to be more readily made aseptic and, therefore, more suitable for use in a patient.

The method of practicing the invention includes the steps of generating a laminar flow of coagulation fluid having an upstream direction and a downstream direction and introducing a biopolymer stream into the laminar flow. The coagulation fluid envelops the biopolymer stream and propels it in the downstream direction while coagulating it. In this way, a biopolymer fiber is formed. The biopolymer fiber may then be separated from the coagulation fluid if desired. In one embodiment, the separation is accomplished by providing a fluid diverter. In another embodiment, the separation is accomplished by surrounding the fiber with a dehydration fluid.

The foregoing and other objects, features, and advantages of the invention will be apparent from the following description and apparent from the accompanying drawings, in which like reference characters refer to the same parts throughout the different views. The drawings illustrate principles of the invention and are not necessarily to scale.

DETAILED DESCRIPTION

Figure 1:
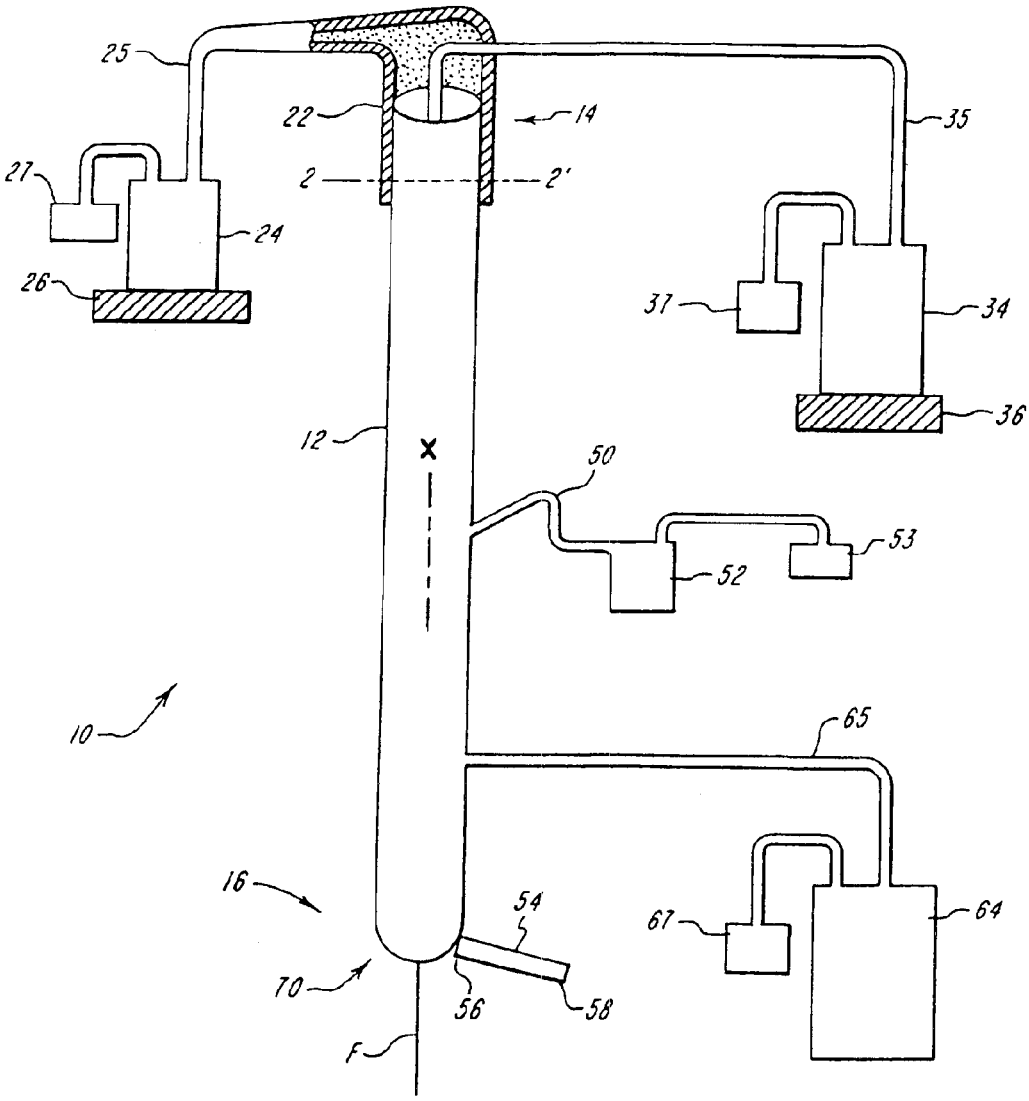
FIG. 1 shows a biopolymer formation apparatus in accordance with the principles of the invention.

Referring to FIG. 1, an apparatus 10 for the formation of a biocompatible biopolymer fiber F in accordance with the principles of the invention includes a fiber-formation tube 12 extending along a tube axis X in a generally vertical direction between an upper end 14 and a lower end 16. The length of the fiber-formation tube 12 is sufficient to enable a liquid biopolymer extruded into a flow of coagulation fluid at the upper end 14 to coagulate into a biopolymer fiber before it emerges from the lower end 16. Typically, the length of the fiber-formation tube 12 is selected to be between about three inches and about two hundred forty inches, although other lengths can also be used.

The word "biocompatible" as used herein, describes a substance exhibiting essentially no cytotoxicity while in contact with body fluids or tissues. Both the material and its degradation products are non-toxic. The word "biopolymer" as used herein includes naturally-occurring polymers or man-made polymers from naturally-occurring components. Substances used to make biopolymers include, but are not limited to, collagen, laminin, elastin, fibronectin, fibrinogen, thrombospondin, gelatin, polysaccharides, poly-L-amino acids, and combinations thereof.

Figure 2:
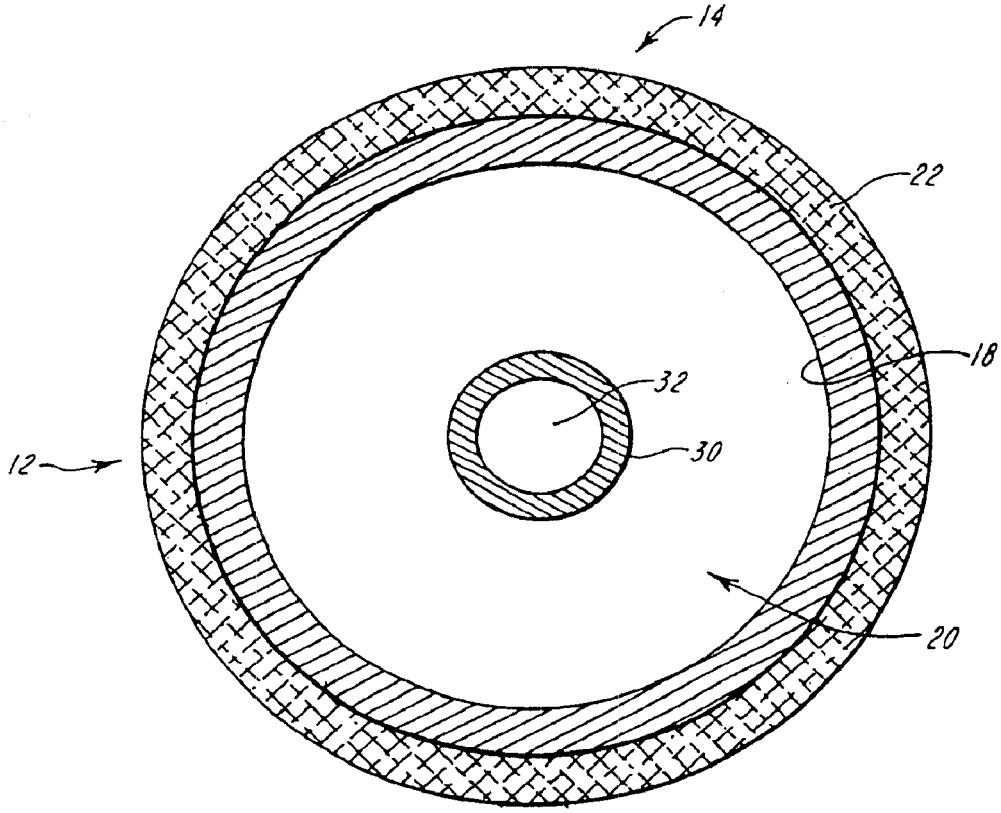
FIG. 2 shows a cross section along the line 2–2' at the upper end of the fiber-formation tube shown in FIG. 1.

As shown in cross-section in FIG. 2, the fiber-formation tube 12 is a hollow cylindrical tube having an inner wall 18 defining a bore or lumen 20 coaxial with the fiber-formation tube 12. Since fluid flow is generally laminar immediately adjacent to a surface such as the inner wall 18, it is preferable to select the diameter of the bore 20 to be small enough to enhance the likelihood of uniform laminar flow throughout its cross-section. It is thus preferable to select the diameter of the bore 20 to be no wider than necessary to accommodate the diameter of the biopolymer fiber F to be formed, together with an annular layer of coagulation fluid between the biopolymer fiber F and the inner wall 18. This diameter will depend on the viscosity and rate of flow of the coagulation fluid. However, a typical range of diameters for the bore 20 is a range between about 0.01 and 0.10 inches. Preferably, the diameter of the bore 20 is about 0.032 inches, although other diameters can also be used.

Figure 3:
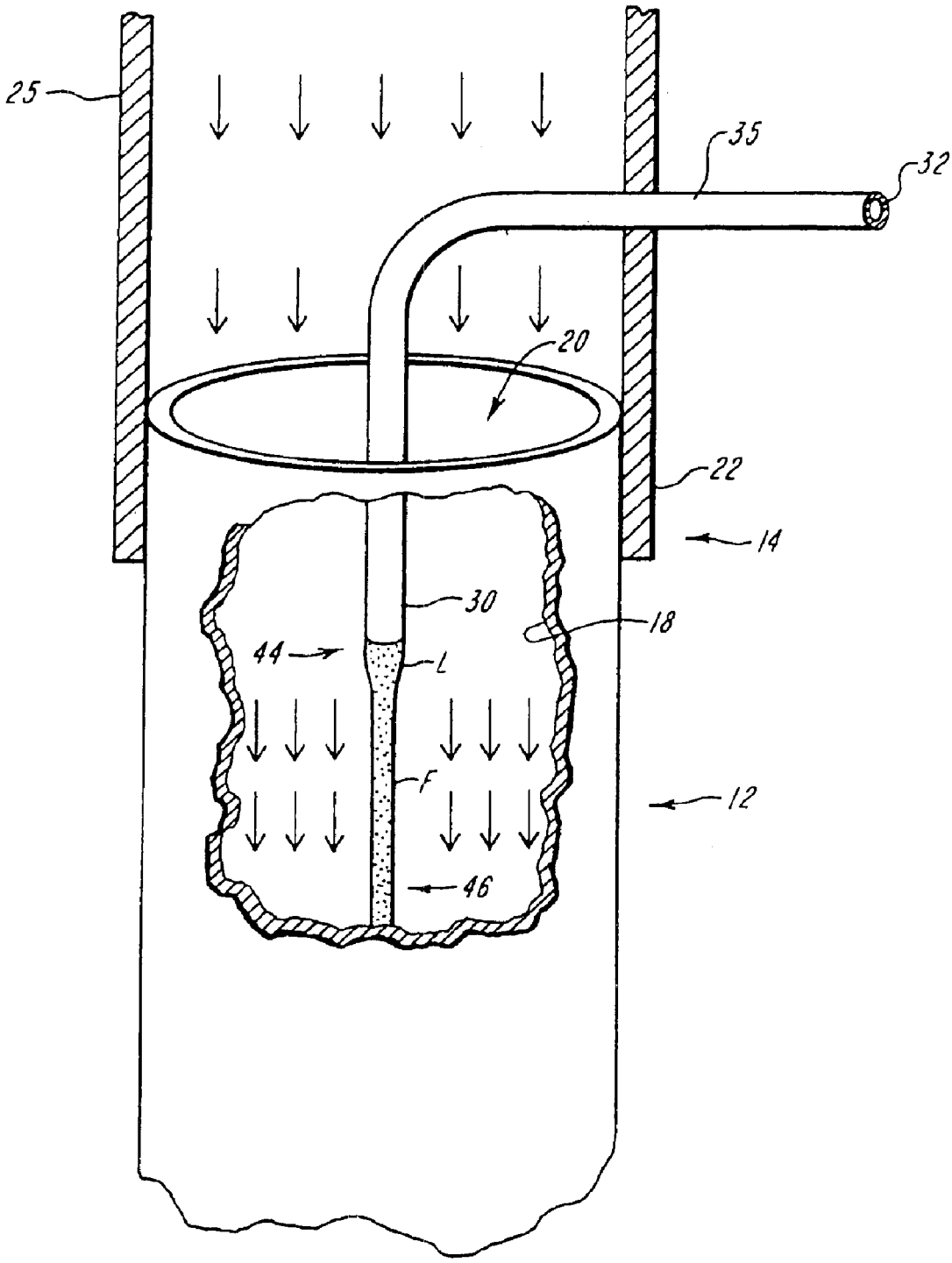
FIG. 3 is a cut-away view of the fiber-formation tube shown in FIG. 1, offering a more detailed view of a spinneret mounted at its upper end.

With references to FIGS. 1 to 3, the upper end 14 of the fiber-formation tube 12 supports a coagulation-fluid inlet 22, best seen in the cut-away view of the upper end 14 in FIG. 3 and in cross-section in FIG. 2. This coagulation-fluid inlet 22 is coupled to a coagulation-fluid reservoir 24 by a coagulation-fluid feeder tube 25. In a preferred embodiment, the coagulation fluid feeder tube 25 is an elastomeric feeder tube and the coagulation fluid inlet 22 is formed by stretching the end of the elastomeric feeder tube over the upper end 14 of the fiber-formation column 12. The coagulation-fluid reservoir 24 contains a coagulation fluid that changes the form of the biopolymer from liquid to semisolid by changing the pH, the solution structure, and/or the temperature. Examples of liquids that can change solution structure include organic solvents (including ethanol, acetone, and methanol) or salts (such as NaCl or ammonium sulfate) that precipitate proteins. Examples of liquids that can change pH include buffering agents such as phosphate, HEPES (N-(2-hydroxyethyl)piperazine-$N^1$-(2-ethanesulfonic acid)), triethanolamine, tricine, trizma, and CAPS (3-(cyclohexylamino)-1-propanesulfonic acid). Ranges of buffering agent concentrations are between 3 mM and 1000 mM. Preferably, the ranges are between 10 mM and 200 mM, and more preferably, between 50 mM and 100 mM. For triethanolamine coagulation fluids, the concentration of triethanolamine is between about 10 and 200 mM. For HEPES coagulation fluids, the HEPES concentration is typically in the vicinity of 100 mM. The buffer is selected such that the pH can be maintained between 6.5 and 10 with a preferred pH between 7.5 and 8.5.

Preferably, the coagulation-fluid reservoir 24 includes a temperature controller 26 for maintaining the temperature of the coagulation fluid in the range between about 4° C. and 37° C. A head source 27 is disposed in fluid communication with the coagulation-fluid reservoir 24 through the fiber-formation tube 12. The head source 27 can be a compressor in pneumatic communication with a headspace in the coagulation-fluid reservoir 24 and adapted to deliver coagulation fluid by metering an inert gas under pressure into the headspace of the reservoir. Alternatively, the head source 27 can be a metering pump through which a metered quantity of coagulation fluid is pumped through the coagulation fluid feeder tube 25.

The upper end 14 of the fiber-formation tube 12 also supports a spinneret 30, best seen in FIG. 3, and in cross-section in FIG. 2. The spinneret 30 is a generally cylindrical tube defining a lumen 32 through which liquid biopolymer passes before entering the fiber-formation tube 12. The tube forming the spinneret 30 has a length typically between about 1 inch and about 3.5 inches. The lumen 32 of the spinneret 30 has a diameter between about 0.006 inches and about 0.016 inches, although other lengths and diameters can also be used.

The spinneret 30 is coupled to a biopolymer reservoir 34 by a biopolymer-feeder tube 35. The biopolymer reservoir 34 contains a liquid biocompatible biopolymer, such as a liquid collagen solution, that coagulates when exposed to the coagulation fluid. A preferred liquid collagen solution used in the practice of the invention has a collagen concentration between about 1 and 60 mg/ml and more preferably between 10 and 20 mg/ml. Preferably, the biopolymer reservoir 34 includes a temperature controller 36 for maintaining the temperature of the biopolymer at approximately 4° C. A head-source 37 in fluid communication with the biopolymer reservoir 34 drives the liquid biopoly in the biopolymyer reservoir 34 through the biopolymer-feeder tube 35 and into the fiber-formation tube 12. The head source 37 can be a compressor in pneumatic communication with a headspace in the biopolymer reservoir 34 and adapted to deliver liquid biopolymer by metering an inert gas under pressure into the headspace of the reservoir. Alternatively, the head source 37 can be a metering pump through which a metered quantity of liquid biopolymer is pumped through the biopolymer-feeder tube 35.

In one embodiment, the spinneret 30 is mounted at an angle to the axis X of the fiber-formation tube 12 so that liquid biopolymer extruded from the spinneret 30 emerges as far as possible from the inner wall 18 of the fiber-formation tube 12. Alternatively, the spinneret 30 can be mounted so that liquid biopolymer extruded from the spinneret 30 is introduced coaxial to the axis X of the fiber-formation tube 12. Both of these dispositions of the spinneret 30 reduce the possibility that the biopolymer stream will be swept against the inner wall 18 by the flow of coagulation fluid.

The pressure provided by the head source 37 establishes a flow of liquid biopolymer into the bore 20 of the fiber-formation tube 12 by forcing liquid biopolymer from the biopolymer reservoir 34, through the biopolymer-feeder tube 35, through the lumen 32 of the spinneret 30, and into the bore 20. The volume rate of flow of liquid biopolymer through the spinneret 30, and hence into the fiber-formation tube 12, can be controlled by regulating the output of the head source 37.

Likewise, the pressure provided by the head source 27 establishes a flow of coagulation fluid into the bore 20 of the fiber-formation tube 12 by forcing coagulation fluid from the coagulation-fluid reservoir 24, through the coagulation-fluid feeder tube 25, through the coagulation-fluid inlet 22, and into the bore 20. The volume rate of flow of coagulation fluid into the fiber-formation tube 12 can be controlled by regulating the output of the head source.

As the coagulation fluid flows downstream in the fiber-formation tube 12, the non-uniform flow dissipates and the flow becomes progressively uniform, until it is generally, substantially, and completely uniform along at least a portion of the tube 12. The fluid flow present in this second zone, referred to as the laminar zone 44, is schematically illustrated in FIG. 3. As shown in FIG. 3, the spinneret 30 is advantageously mounted so that liquid biopolymer L extruded from the spinneret 30 emerges into a laminar flow of coagulation-fluid in the laminar zone 44. This laminar flow of coagulation-fluid enables the biopolymer stream to remain intact. As a result, upon exposure to the laminar flow of coagulation fluid, the liquid biopolymer L coagulates into a continuous fiber F as it flows through a coagulation zone. All liquids to be used in the system are degassed sufficiently by methods known by one of ordinary skill in the art to prevent possible changes in flow rate caused by the formation of bubbles within the tubing bores.

Because the laminar flow of coagulation fluid is in contact with the liquid biopolymer, the velocity of the coagulation fluid and the velocity of the liquid biopolymer are coupled. This allows the liquid biopolymer L to be swept downstream by the flow of the coagulation fluid. As a result, it is possible to adjust the diameter of the resulting fiber F by adjusting the relative flow velocities of the coagulation fluid flowing through the fiber-formation tube 12 and the liquid biopolymer flowing through the spinneret 30. This can be achieved by adjusting the flow-rate of the coagulation fluid, the flow rate of the liquid biopolymer, or both. When the coagulation fluid flows slowly relative to the liquid biopolymer, the stream of liquid biopolymer coagulates before the flow of coagulation fluid can reduce the diameter of the extruded stream significantly. The biopolymer fiber thus formed is relatively coarse. Conversely, if the coagulation fluid flows quickly relative to the liquid biopolymer, the biopolymer stream is drawn out into a thin fiber by the flow before it can fully coagulate. The fiber thus formed is relatively fine. A fine fiber is preferable for forming the scaffolding used in tissue replacement because such a fiber has dimensions that are closer to those of naturally occurring collagen fibers. A fine fiber also has greater tensile strength and can be dried at higher speeds without a significant risk of breakage.

Since the diameter of the bore 20 of the fiber-formation tube 12 is only slightly larger than the diameter of the fiber, there is a possibility that the fiber will contact the inner wall 18 of the fiber-formation tube 12 before reaching the fluid outlet 70. This can result in undesirable mechanical stress on the fiber. Additionally, the fiber could adhere to the inner wall 18. If this were to occur, a loop of fiber would form in the bore as additional fiber extruded from the spinneret 30 passes downstream of the portion of fiber adhered to the inner wall 18. This could quickly result in blockage of the bore 20.

The laminar flow of coagulation fluid in the fiber-formation tube 12 reduces the likelihood of the above-mentioned risks by reducing the likelihood that the fiber will contact the inner wall 18 of the fiber-formation tube 12. This occurs because the fiber will naturally follow the streamlines of the flow in which it is placed. Since the streamlines in laminar flow are parallel to the inner wall 18, and since the stream of liquid biopolymer is introduced along the axis X of the fiber-formation tube 12, the laminar flow in the bore 20 will tend to maintain the fiber collinear with the axis X of the fiber-formation tube 12 and away from the inner wall 18. This results in a fiber having a circular cross-section and minimal surface imperfections.

The embodiment of the present invention disclosed herein thus provides a spinneret 30 for extruding a stream of liquid biopolymer L into a downward laminar flow of coagulation fluid in a generally vertical fiber-formation tube 12. The extruded liquid biopolymer L is swept downward by the laminar flow of coagulation fluid and coagulated into a biopolymer fiber F. The diameter of this biopolymer fiber F can be controlled by adjusting the fluid velocity of the coagulation fluid.

It will be apparent to one of ordinary skill in the art that the fiber-formation tube 12 need not be exactly vertical but can instead be canted at an angle relative to the direction of the gravitational force vector or any other force field acting on the fiber. What is important is that the fiber-formation tube 12 be oriented such that the force exerted by the laminar flow prevents the fiber from contacting the inner wall 18 of the fiber-formation tube 12 as the fiber proceeds from the coagulation zone 46 to the fluid outlet 70.

A perfectly vertical fiber-formation tube 12 has the desirable property that the gravitational force has no component that directs the fiber toward the inner wall 18. However, a canted fiber-formation tube 12 can be used, provided that the radially-inward force exerted by the laminar flow is sufficient to overcome the component of gravitational force directed toward the inner wall 18. The range of suitable angles at which the fiber-formation tube 12 can be canted will be determined in part by the coagulation fluid flow velocity, the coagulation fluid viscosity, the density of the fiber, the fiber diameter, and the diameter of the bore 20. Hence, as used in the specification and claims, the terms "substantially vertical" or "generally vertical" refer to orientations such that laminar flow prevents the fiber from contacting the inner wall 18 of the fiber-formation tube 12.

The fiber-formation apparatus 10 and method disclosed herein offers numerous advantages. It is known, for example, that a typical biopolymer fiber resists forces directed along its axis more readily than transverse forces. Because the fiber in the disclosed apparatus is suspended generally vertically, the predominant force acting on the fiber, which is that due to its own weight, is directed along the fiber's axis. Since the fiber is not subject to excessive transverse forces, it is unlikely to fragment during formation. As a result, it is possible to form extremely long and very fine continuous fibers.

Another advantage of the apparatus and method disclosed herein is that since the fiber-formation tube 12 through which coagulation fluid flows has such a narrow bore 20, only a small volume of coagulation fluid is necessary to coagulate the stream of liquid biopolymer extruded from the spinneret 30. As a result, it is economically feasible to discard the coagulation fluid after use. Because the coagulation fluid in contact with the fiber comes directly from the coagulation-fluid reservoir 24, it is consistent in composition and pH. As a result, it is more likely that a fiber manufactured in the manner disclosed herein will be uniform in its properties. An additional advantage of the narrow bore fiber-formation tube 12 disclosed herein is that low-viscosity coagulation fluids can be used. Such coagulation fluids are simpler to formulate and prepare than high-viscosity coagulation fluids and enable extremely fine fibers to be readily separated from the coagulation fluid without use of mechanical supports that make physical contact with the fiber.

Yet another advantage of the apparatus and method disclosed herein is that the coagulation fluid is completely enclosed by the fiber-formation tube 12. Hence, there is little or no likelihood that any coagulation fluid will be lost due to evaporation or that the concentration of coagulating agent in the coagulation fluid will change as a result of evaporation. In addition, there is less likelihood that the coagulation fluid, and potentially the fiber itself, will be contaminated by airborne particulate matter or microorganisms.

Because virtually no mechanical stresses are imposed on the fiber in the coagulation zone 46, the rate of fiber formation need not be constrained by efforts to avoid mechanical stress. The rate of fiber formation is thus limited only by how rapidly the fiber can be extruded from the spinneret 30 and how rapidly the fiber can be made to coagulate and flow down the fiber-formation tube 12. As a result, the throughput associated with fiber formation can be much higher than is achievable with conventional methods.

Figure 4:
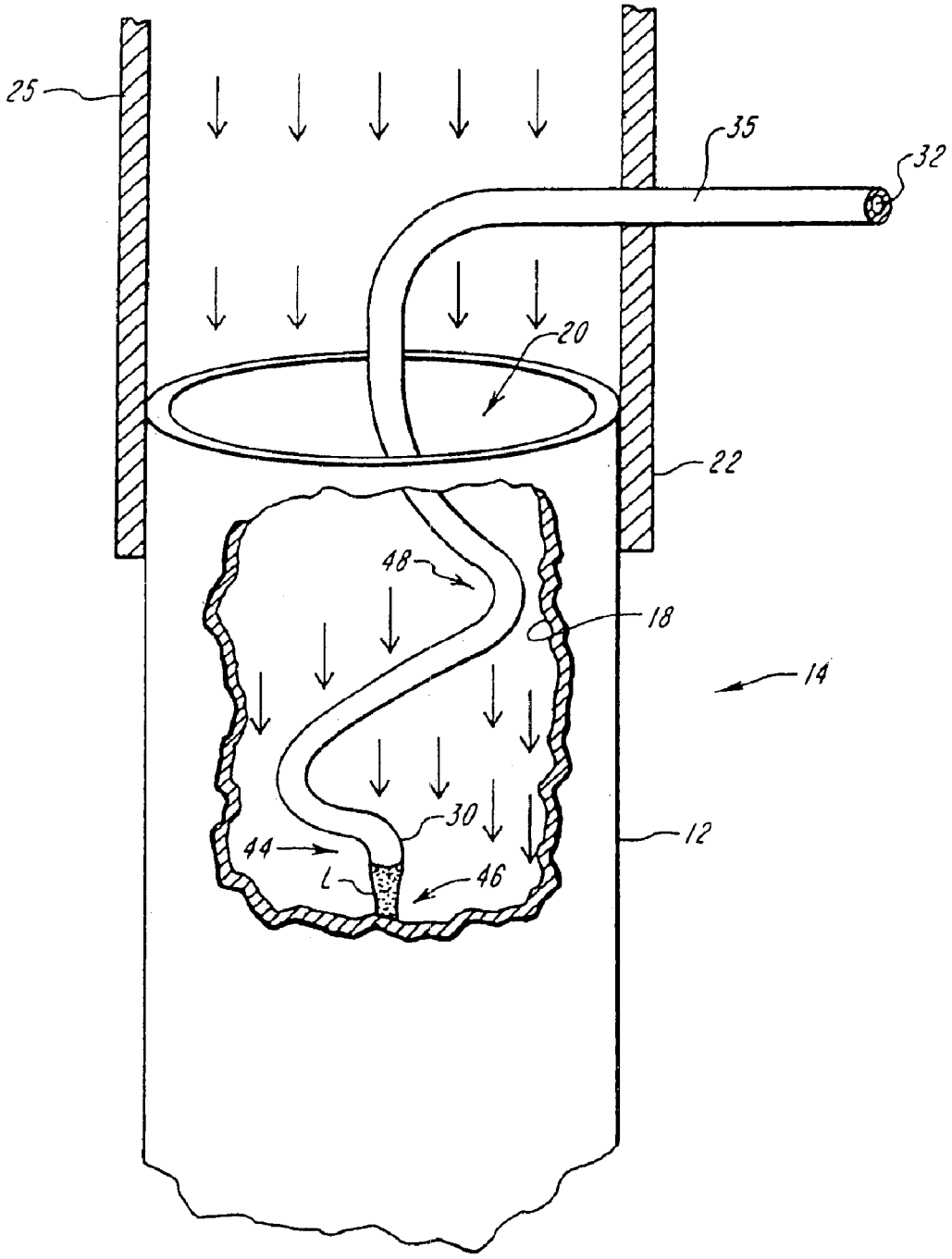
FIG. 4 is a cut-away view of a filter-formation tube showing details of the manner in which the spinneret is mounted in the tube.

A variety of methods are available for anchoring the spinneret 30 so that liquid biopolymer is extruded along an axis coaxial with the axis X of the fiber-formation tube 12. A typical method, shown in the cut-away view of the upper end 14 of the fiber-formation tube 12 in FIG. 4, is to provide an anchoring element 48 extending between an outer wall of the spinneret 30 and the inner wall 18 of the fiber-formation tube 12. The anchoring element 48 is adapted to suspend the spinneret 30 in the bore 20 of the fiber-formation tube 12. A simple anchoring element 48, such as that shown in FIG. 4, is formed by bending the biopolymer feeder tube 35 so as to form a bent section. An anchoring element 48 formed in this manner engages the inner wall 18 of the fiber-formation tube 12 and applies a radially directed outward force against the inner wall 18. The anchoring element 48 thereby fixedly secures the spinneret 30 within the bore 20 and coaxial with the fiber-formation tube 12.

In anchoring the spinneret 30 in the bore 20, it is preferable that any non-uniform flow generated by the anchoring element 48 dissipate before reaching the point at which the spinneret 30 extrudes the stream of liquid biopolymer into the coagulation fluid. Consequently, it is preferable that the anchoring element 48 be located well upstream of this point. As shown in FIG. 4, the anchoring element 48 is located far enough upstream from the point at which the spinneret 30 extrudes liquid biopolymer L to ensure uniform flow.

With reference to FIG. 1, an apparatus according to the invention can optionally include a propulsion fluid inlet 50 coupled to the fiber-formation tube 12 at a point downstream from the spinneret 30. Preferably, the diameter of the fiber-formation column 12 is enlarged at the point at which the propulsion fluid inlet 50 joins the fiber-formation column 12. The propulsion fluid inlet 50 is connected to a propulsion fluid source 52 and provides a flow of propulsion fluid to assist the coagulation fluid in propelling the biopolymer stream toward the lower end 16 of the fiber-formation tube 12. The propulsion fluid source is connected to a head source 53 for driving the propulsion fluid into the fiber-formation tube 12. The configuration for driving the propulsion fluid is similar to that already discussed in connection with the biopolymer reservoir 34. Preferred propulsion fluids include coagulation fluid, water or saline.

Figure 5:
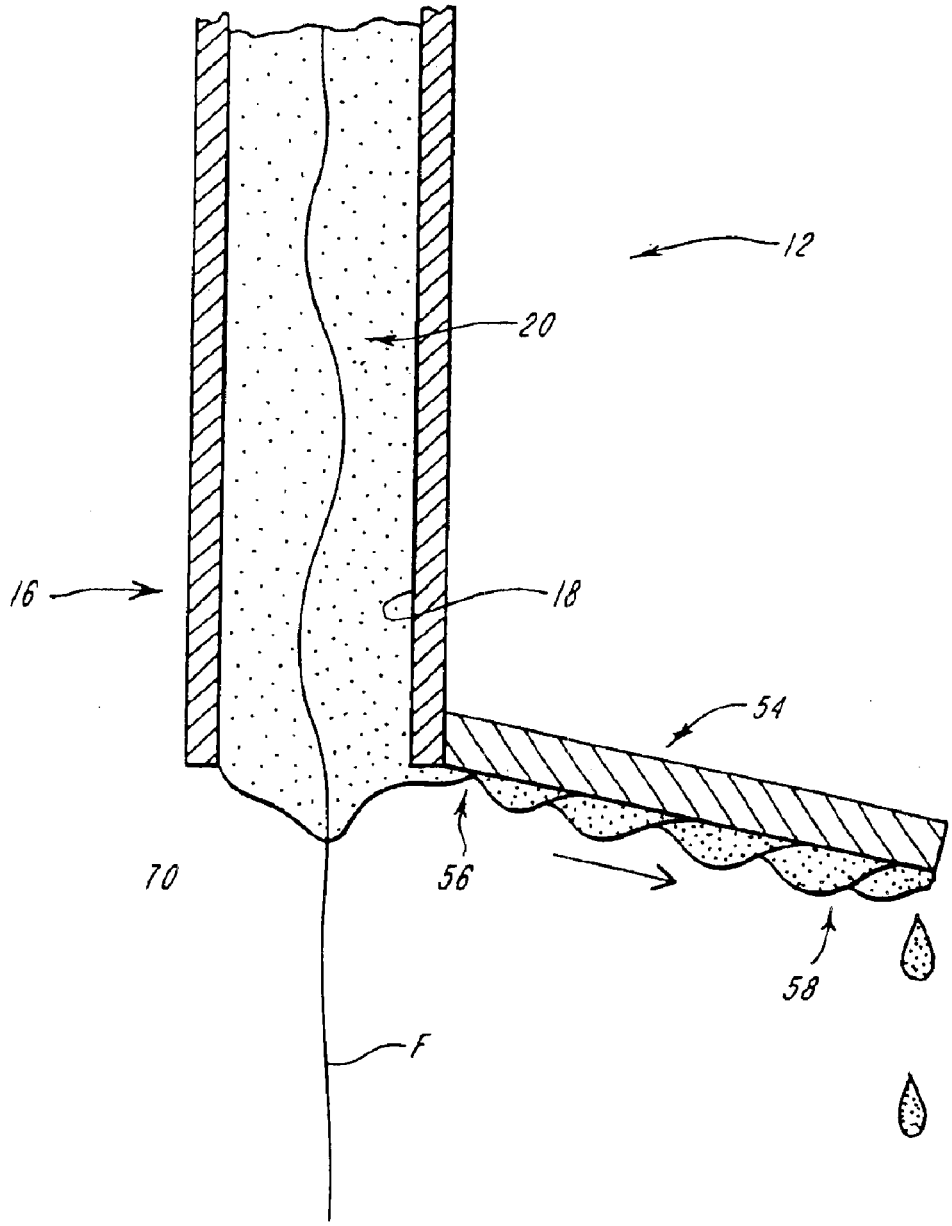
FIG. 5 shows a fluid diverter mounted at the lower end of the fiber-formation tube shown in FIG. 1.

A wet biopolymer fiber is typically significantly more fragile than a dry fiber. In cases where a dry fiber is required, it is desirable that the wet fiber emerging from the lower end 16 of the fiber-formation tube 12 be dried before being wound onto a spool. To accelerate the drying process, the apparatus can include a fluid diverter 54 disposed at the lower end 16 of the fiber-formation tube 12, as shown in FIG. 5, for separating the fiber from the coagulation fluid.

At a fluid outlet 70 located at the lower end 16 of the fiber-formation tube 12, the bulk of the coagulation fluid that has not been absorbed by the fiber itself clings to the inner wall 18 of the fiber-formation tube 12. A suitable fluid diverter 54 can thus be a plate having a fluid-capturing end 56 proximal to the fluid outlet 70 and a fluid-drainage end 58 distal to the fluid outlet 70. The plate is held at an incline with the fluid-drainage end 58 lower than the fluid-capturing end 56. As a result of this incline, coagulation fluid that flows onto the fluid-capturing end 56 flows radially away from the fiber and toward the fluid-drainage end 58.

Figure 6:
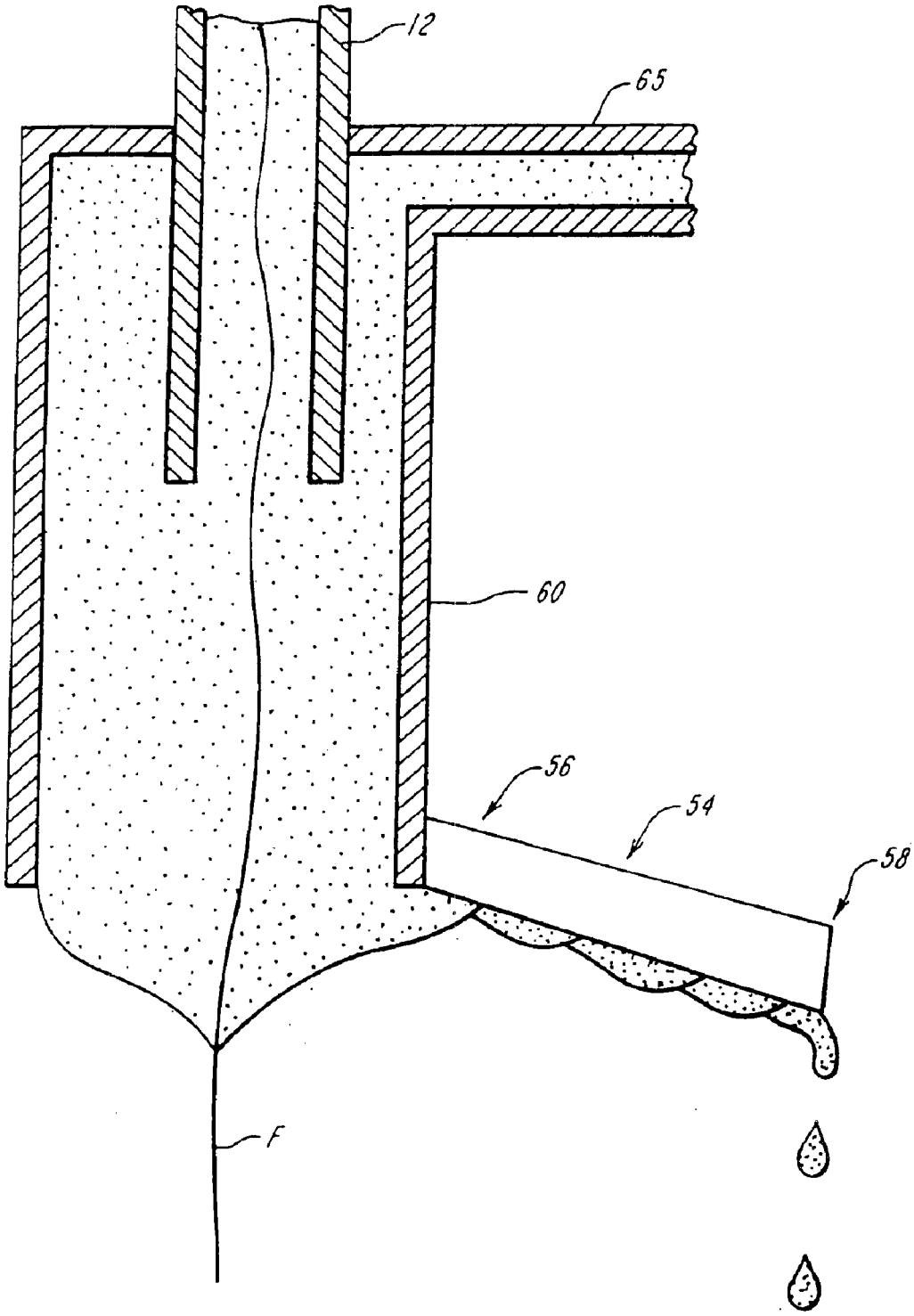
FIG. 6 shows a dehydration tube mounted at the lower end of the fiber-formation tube shown in FIG. 1.

To further assist the drying process, an apparatus 10 incorporating the principles of the invention can further include a dehydration tube 60 mounted coaxially with the fiber-formation tube 12, as shown in FIG. 6. The dehydration tube 60 is coupled to a dehydration-fluid reservoir 64 by a dehydration-fluid feed tube 65. A head source 67 in fluid communication with the dehydration-fluid reservoir 64 forces dehydration-fluid from the dehydration-fluid reservoir 64, through the dehydration-feed tube 65, and into the dehydration tube 60. The dehydration fluid can also be fed through a metering pump. Examples of suitable dehydration fluids include alcohols, such as methanol and ethanol, and other organic solvents such as acetone. A preferred dehydration fluid is ethanol at a concentration of 100%.

In an embodiment incorporating the illustrated dehydration tube 60, the biopolymer fiber, which is wetted by coagulation fluid, passes coaxially through the dehydration tube 60 where it is placed into contact with dehydration fluid. The dehydration fluid is selected to displace water contained in, and coagulation fluid absorbed by, the biopolymer fiber and also to evaporate readily when exposed to air. The surface of the biopolymer fiber F emerging from the dehydration tube 60 is thus wetted predominantly by dehydration fluid which evaporates far more readily than coagulation fluid.

In another embodiment, the fiber-formation tube 12 is horizontal. In such an embodiment, the fiber is preferably very light and the coagulation-fluid flow velocity is relatively high so that the laminar flow of coagulation fluid can maintain the position of the fiber away from the inner wall 18.

The biopolymer fiber formed by the apparatus of the invention can be treated with cross-linking agents to control the rate of modeling and to add strength to the fiber. Cross-linking agents can be included in any part of the fiber formation process. For example, they can be used to treat unpolymerized collagen, coagulated wet fiber, or dry fiber.

The point at which the cross-linking agent is included in the process depends on the type of cross-linking agent used. Cross-linking agents known in the art include aldehydes such as glutaraldehyde and formaldehyde; sugars such as ribose and fructose; acrylamides, such as N,N'-methylenebisacrylamide; carbodiimides, such as 1-ethyl-3-(dimethyaminopropyl) carbodiimide; diones such as 2,5-hexanedione; diimidates, such as dimethylsuberimidate; and iridoid derivatives, such as genipin. A preferred cross-linking agent is genipin or 2,5-hexanedione. In addition to being treated by chemical cross-linking agents, dry fibers can also be treated by physical cross-linking agents. Examples of physical cross-linking agents include UV light and dehydrothermal treatment.

The biopolymer fiber formed by the apparatus or method of the invention can then be seeded with extra-cellular matrix particulates, DNA, or stem cells and bathed in drugs or growth factors so as simulate, as closely as possible, a naturally occurring fiber or a fiber with enhanced biochemical signaling properties. Alternatively, additives such as growth factors, drugs, and other materials can be added to the liquid biopolymer in the biopolymer reservoir 34 so that they pervade the entire volume, and not just the surface of the collagen fiber formed by the apparatus of the invention. This can result in the continuous release of these additives over time as the fiber, now implanted in vivo, undergoes remodeling. Such a fiber, when implanted into a patient, can then serve as a suitable scaffolding for encouraging growth of natural tissue and accelerating the patient's healing process.

Having described the invention and a preferred embodiment thereof, what is claimed as new and secured by Letters Patent is:

1. A method for forming a fiber from a biocompatible biopolymer, the method comprising the steps of creating a vertically-directed flow of coagulation fluid having an upstream direction and a downstream direction, injecting, into the downstream direction of the vertically-directed flow of coagulation fluid, a stream of biocompatible biopolymer selected to coagulate in response to contact with the coagulation fluid, the stream being injected so as to be surrounded by coagulation fluid and propelled in the downstream direction by the vertically-directed flow of coagulation fluid, and allowing the coagulation fluid to coagulate the biopolymer stream, thereby forming a biopolymer fiber.

2. The method of claim 1 further comprising the step of separating the biopolymer fiber from the coagulation fluid.

3. A method for forming a fiber from a biocompatible biopolymer, the method comprising the steps of creating a laminar flow of coagulation fluid having an upstream direction and a downstream direction, injecting, into the downstream direction of the laminar flow of coagulation fluid, a stream of biocompatible biopolymer selected to coagulate in response to contact with the coagulation fluid, the stream being injected so as to be surrounded by coagulation fluid and propelled in the downstream direction by the laminar flow of coagulation fluid, and allowing the coagulation fluid to coagulate the biopolymer stream, thereby forming a biopolymer fiber.

4. The method of claim 3 further comprising the step of separating the biopolymer from the coagulation fluid.

5. The method of claim 3 further comprising the step of passing the biopolymer fiber through a dehydration fluid.

6. The method of claim 3 wherein the step of separating the biopolymer fiber from the coagulation fluid comprises the step of providing a fluid diverter.

7. The method of claim 3 further comprising the step of selecting the biocompatible biopolymer to be a liquid collagen solution.

8. The method of claim 7 wherein the step of selecting liquid collagen solution comprises the step of selecting a collagen solution having a concentration between about 1 mg/ml and about 60 mg/ml.

9. The method of claim 3 further comprising the step of selecting said coagulation fluid to be a solution of a buffering agent.

10. The method of claim 3 further comprising the step of maintaining the biocompatible biopolymer at a temperature of approximately 4° C.

11. The method of claim 3 further comprising the step of maintaining the coagulation fluid at a temperature of between about 4° C. and about 37° C.

12. The method of claim 3 further comprising the step of providing a flow of propulsion fluid to propel the biopolymer stream in the downstream direction.

* * * * *